US007066286B2

(12) United States Patent
Nguyen et al.

(10) Patent No.: US 7,066,286 B2
(45) Date of Patent: Jun. 27, 2006

(54) GAGE SURFACE SCRAPER

(75) Inventors: Don Q. Nguyen, Houston, TX (US); Terry J. Koltermann, The Woodlands, TX (US); Gregory L. Ricks, Spring, TX (US); Mark E. Morris, Lafayette, LA (US); Chris M. McCarty, Houston, TX (US); Chih C. Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 198 days.

(21) Appl. No.: 10/809,644

(22) Filed: Mar. 25, 2004

(65) Prior Publication Data

US 2005/0211474 A1 Sep. 29, 2005

(51) Int. Cl.
*E21B 10/00* (2006.01)

(52) U.S. Cl. ..... 175/313

(58) Field of Classification Search ..... 175/313, 175/331, 336, 382, 371
See application file for complete search history.

(56) References Cited

U.S. PATENT DOCUMENTS

| | | | | |
|---|---|---|---|---|
| 1,641,261 | A * | 9/1927 | Fletcher | 175/371 |
| 2,769,616 | A | 11/1956 | Morlan et al. | |
| 2,960,313 | A | 11/1960 | Goodwin | |
| 4,515,228 | A | 5/1985 | Dolezal et al. | |
| 4,688,651 | A * | 8/1987 | Dysart | 175/371 |
| 5,056,610 | A | 10/1991 | Oliver et al. | |
| 6,026,917 | A * | 2/2000 | Zahradnik et al. | 175/371 |
| 6,196,339 | B1 * | 3/2001 | Portwood et al. | 175/371 |

* cited by examiner

*Primary Examiner*—David Bagnell
*Assistant Examiner*—Daniel P Stephenson
(74) *Attorney, Agent, or Firm*—Bracewell & Giuliana LLP

(57) ABSTRACT

A gage scraper cleans mud from the gage surface of a rotary cone of a drill bit. The bit has a body having at least one leg depending therefrom, a bearing pin secured to each leg, and a rotary cutting cone mounted to the bearing pin. The cone has a conical gage surface. The gage scraper mounts on the inside of each leg and protrudes from the leg toward the cone into close proximity with the gage surface.

17 Claims, 2 Drawing Sheets

GAGE SURFACE SCRAPER

1. FIELD OF THE INVENTION

This invention relates generally to earth boring drill bits, and more particularly to a scraper for cleaning the gage surface of a rotary cone.

2. BACKGROUND OF THE INVENTION

One type of earth boring drill bit, particularly for oil and gas wells, has three rotating cones angling inward toward the center axis of the drill bit. The cones are mounted on bearing pins of legs that extend downward from a bit body. Each cone has a backface closely spaced to a portion of the bit leg called a last machined surface. As the body rotates about its axis, each of the cones simultaneously rotates about its own axis. Drilling mud is pumped down the drill string and flows out of nozzles on the drill bit body. The mud and cuttings return up an annulus surrounding the drill string.

It has long been recognized in the drill bit industry that the longevity of rotary cone drill bits is increased if foreign material or debris such as mud is prevented from entering the bearings associated with each of the cones. Drill bits used in carrying out rotary drilling have been subject to wear and damage by virtue of erosion caused by the abrasive effect of the foreign materials present in the drilling process. Mud and solids from the earthen formation pack onto certain portions of the bit structure, including the gage surface. Mud packing on the gage surface can cause mud and cuttings to pack into the seal gland, hindering performance. The rate of penetration can be limited by excessive contact with the borehole wall. Drilled solids adhering to a cone's surface will increase the amount of contact with the borehole wall, and may reduce penetration rates.

In the past, various versions have been employed to address the foregoing problem. Devices to mechanically deflect foreign material from between the cone backface and the leg are known, such as pins mounted to the bit leg in close proximity to the backface. These devices are somewhat helpful in solving the problem of material build-up in some respects, but fail to contribute to the removal of mud cuttings in other respects.

3. SUMMARY

This invention provides a device that improves the cleaning of foreign material or debris from the drill bit when used in earth boring procedures. Particularly, it provides an improved device for cleaning foreign material or debris from the gage surface of a rotary cone. The bit has a body having at least one leg depending therefrom, a bearing pin secured to each leg, and a rotary cutting cone mounted to the bearing pin. The cone has at least one conical gage surface which during drilling operations may collect foreign material or debris such as mud.

A scraper is mounted on the inside of each leg. The scraper protrudes from the leg toward the cone into close proximity with a gage surface, enabling the scraper to clean foreign material or debris from the gage surface of the cone.

The novel features of this invention, as well as the invention itself, will best be understood from the following drawings and detailed description.

4. BRIEF DESCRIPTION OF THE DRAWINGS

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
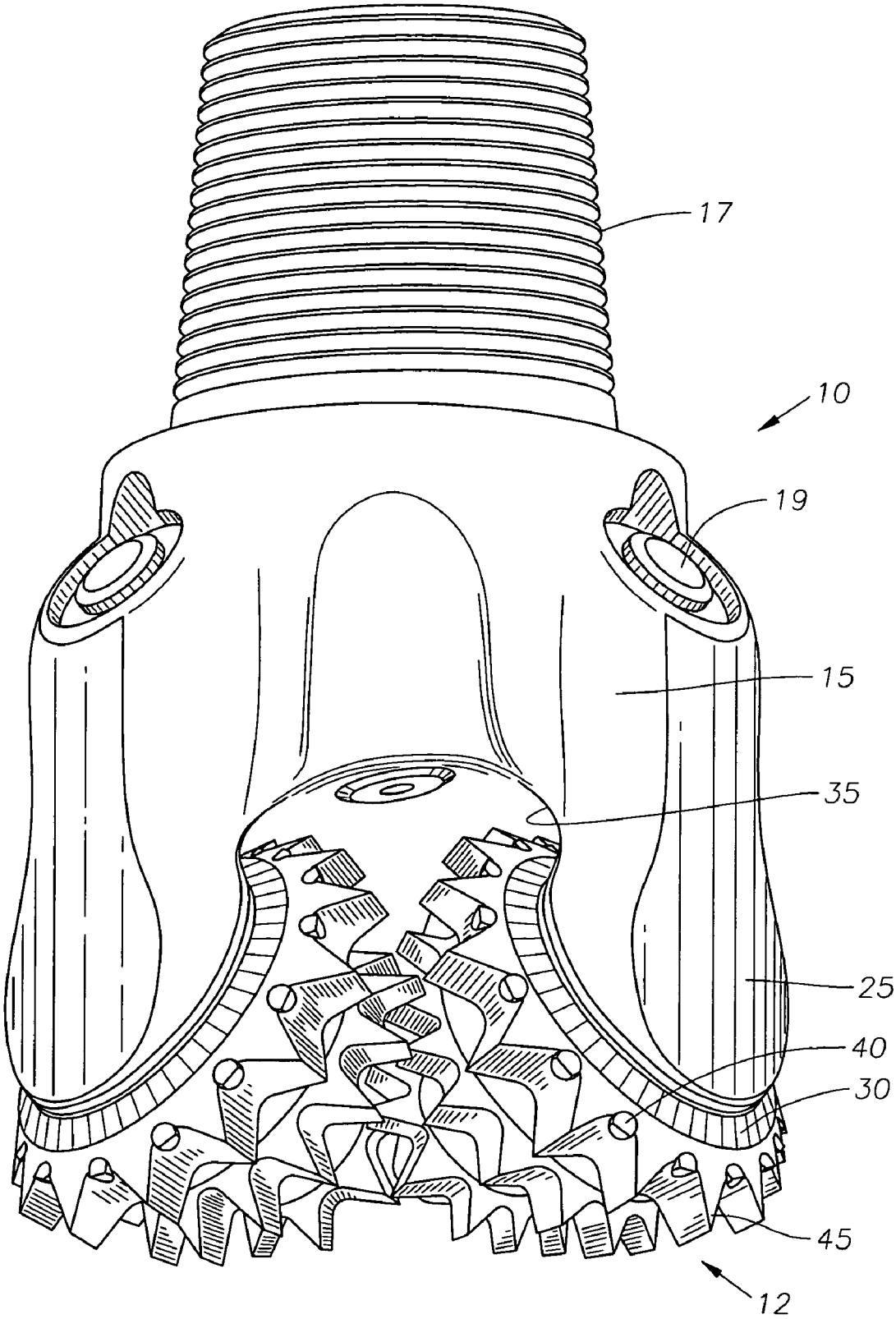
FIG. 1 shows a front view of a drill bit constructed in accordance with the invention.

FIG. 1 shows a front view of a drill bit 10 with three rotary cones 12 used in earth boring operations. The drill bit 10 has a solid body 15, and a threaded section 17 projects from the body 15 at its upper end for attachment to the lower end of a drill string (not shown). A leg 25 for each cone 12 depends from the body 15. In this preferred embodiment, which is one of many possible alternative embodiments, three legs 25 are spaced 120 degrees apart from each other about the axis of rotation of the drill bit body 15. When operated in a borehole filled with liquid, hydrostatic pressure acts on the drill bit 10 as a result of the weight of the column of drilling fluid. A pressure compensator 19 is mounted in a lubricant reservoir in each leg of the body 15. The pressure compensator 19 communicates with the hydrostatic pressure on the exterior to equalize the pressure on the exterior with lubricant pressure in the passages and clearances within the drill bit 10.

Figure 2:
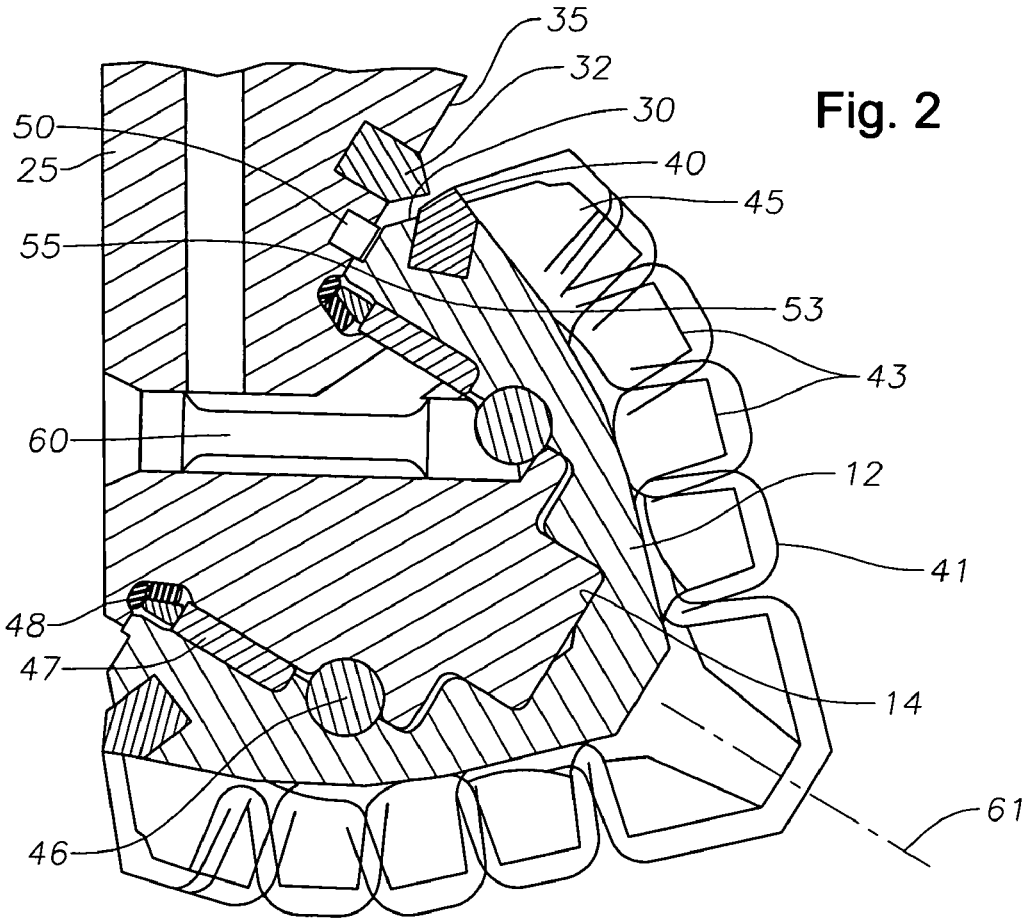
FIG. 2 is a sectional view of one of the cones of FIG. 1 secured to a leg by a bearing pin and having a scraper in accordance with the invention.

In reference to FIG. 2, rotary cone 12 is rotatably secured to a cylindrical bearing pin 60 depending from the bottom end of each of the legs 25, and extending inward from each of the legs 25. The cone 12 is generally conical in shape and rotates on a journal bearing. The legs 25 are preferably designed such that when the rotary cones 12 are secured to the legs 25, the cones 12 face generally inward toward the center axis of the drill bit 10.

A cavity 14 is found in rotary cone 12, and establishes the appropriate space necessary for the cone 12 to fit on the bearing pin 60 attached to the leg 25. An annular backface 53 of the cone 12 surrounds the cavity 14. The backface 53 is substantially perpendicular to the rotary cone axis 61. A conical gage surface 30 extends from the backface 53 to the outer cutting surface 41 of cone 12 at an angle relative to both the backface 53 and the cutting surface 41. There are multiple conical surfaces possible for the gage surface 30, each having its own characteristics, and designed to optimize the performance of the drill bit 10. For example, many different embodiments may feature many alternative angles of the conical gage surface 30 relative to both the backface 53 and the cutting surface 41. A further embodiment is that the conical gage surface 30 could itself comprise two distinct surfaces of different angular positions, both surfaces being between the surfaces of the backface 53 and the cutting surface 41.

A number of rows of cutting elements 43 on the outer cutting surface 41 surround the perimeter of the rotary cone 12. Each row features a number of cutting elements 43 on the outer cutting surface 41 annularly displaced around the cone 12. The closest row to the gage surface 30 comprises the heel row cutting elements 45. The cutting elements 43 disintegrate the earth formations as the cone 12 rotates on the bearing pin 60. The cutting elements 43 may be integrally formed with the cone 12, or pressed into holes (not shown) in the cutting surface 41.

A number of optional trimming elements 40 are positioned on the rotary cone 12 at an intersection of the gage surface 30 and the heel row cutting elements 45. The trimming elements 40 are positioned in the space between each individual heel row cutting element 45. The trimming elements 40 are smaller and provide considerably less of a protruding surface than the heel row cutting elements 45. The heel row elements 45 on the outer cutting surface 41 engage the borehole bottom, while the trimming elements 40 engage the side wall of the borehole. The trimming elements 40 may be hard metal inserts interferingly pressed into holes in the cutting surface 41. Alternatively, the trimming elements 40 could be machined on cutting surface 41 or formed from hard facing. Cone 12 has a conical gage surface 30 at the juncture where the heel row cutting elements 45 are formed on the outer cutting surface 41 of the rotary cone 12. The maximum diameter of the bit 10 is at the gage surface 30. The trimming elements 40 are located at the junction of the gage surface 30 and the heel row cutting elements 45.

In further reference to FIG. 2, bearing pin 60 receives the cone 12 so that the surfaces of the bearing pin 60 and cavity 14 of the cone 12 are in sliding rotational contact. The bearing pin 60 could be in the form of a journal bearing or other such bearing structure. The cone 12 is retained on the bearing pin 60 by a series of ball bearings 46 that engage a mating annular recess formed in the cavity 14 and on bearing pin 60. The ball bearings 46 lock the cone 12 to the bearing pin 60. The bearing spaces of the cone 12 are sealed by an annular seal assembly 48 and an annular sleeve 47, which intersect with the inner cavity 14 of the rotary cone 12.

A surface referred to as the last machined surface 55 is formed where the bearing pin 60 joins the leg 25. The last machined surface 55 is an annular flat surface located in a plane perpendicular to the bearing pin axis 61. The last machined surface 55 faces directly opposite, but does not touch, annular backface 53 of the rotary cone 12, and preferably faces generally inward toward the center axis of the drill bit 10. The last machined surface 55 and the backface 53 of the rotary cone 12 are parallel to each other and substantially perpendicular to the rotary cone axis 61 and bearing pin axis 61. The inner wall surface 35 begins at a juncture of the last machined surface 55 and continues along the inside portion of the leg 25.

Figure 4:
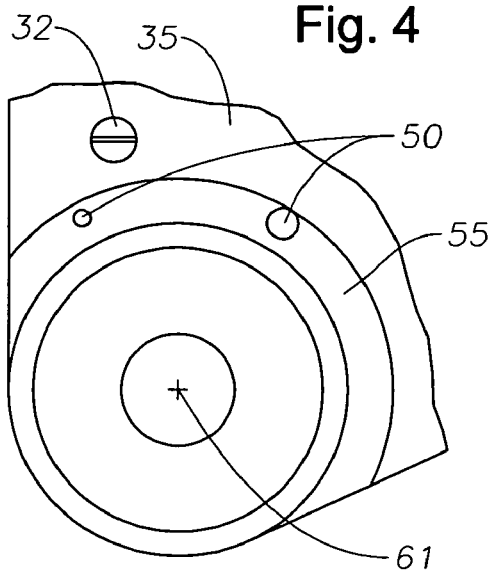
FIG. 4 is a front view along the center axis of the bearing pin of FIG. 2, with the cone removed for clarity.

As shown in FIGS. 2 and 4, a gage surface scraper 32 is fixed to the inner wall surface 35 of the leg 25 outside of the last machined surface 55. The gage surface scraper 32 comprises a carbide insert having a base portion preferably press-fitted into a hole in the inside surface of the leg 25. The scraper 32 may alternatively be shrink-fitted, welded, brazed, or otherwise embedded in the hole. A further alternative involves the inside surface of the leg 25 not having a hole, but installing the gage surface scraper 32 by welding the insert flush against the leg 25. The gage surface scraper 32 is positioned to be generally perpendicular or normal to the bit leg inside surface 32, and is located radially past the last machined surface 55. When viewed in cross-section, the gage surface scraper 32 has flanks 33 on a surface that is substantially parallel to a portion of the gage surface 30.

Figure 3:
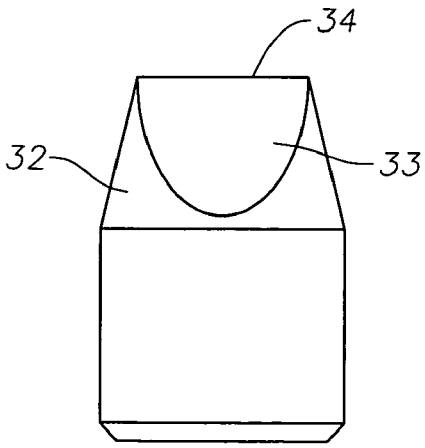
FIG. 3 is a front view of the scraper of FIG. 2.

Preferably, the gage surface scraper 32 is chisel-shaped having two of the flanks 33 converging to a crest 34, as shown in FIG. 3. Alternatively, the gage surface scraper 32 may be manufactured with a hemispherical top. The scraper 32 has an axis that is substantially parallel to the bearing pin axis 61, and the crest 34 is substantially tangent to a circle surrounding the bearing pin axis 61. The crest 34 is generally perpendicular to a radial line of the bearing pin axis 61. The crest 34 protrudes inward relative to the bearing pin axis 61 to a position past the backface 53. The crest 34 of the gage surface scraper 32 extends into close proximity with the gage surface 30 and each trimming element 40 as the trimming elements 40 rotate past the gage surface 30. Close proximity is defined as the crest 34 of the scraper 32 being a fraction of an inch from the gage surface 30, but not in direct contact with the gage surface 30. One flank 33 of the gage scraper 32 is generally parallel with the portion of the gage surface 30 passing it. The distance from the bearing pin axis 61 to the gage surface scraper 32 is greater than the distance from the bearing pin axis 61 to an inner edge of the gage surface 30.

The distance between the crest 34 and the gage surface 30 is preferred to be substantially within the range of 0 inches to 5/16 inches. The gage surface scraper 32 operates to clean foreign material or debris such as mud from the gage surface 30. The gage surface scraper 32 is preferably made of a hardened material such as steel or tungsten carbide, and is press-fitted into a hole in bit leg inside surface 35. The gage surface scraper 32 may alternatively comprise inserts made of materials such as polycrystalline diamond, ceramic, weld metal, tool steel, or other steel material or hardened substance. This preferred embodiment, which is one of many possible alternative embodiments, optimizes the effectiveness and efficiency of the cleaning or scraping operation, while preserving and prolonging the life of the gage surface scraper 32.

As shown in FIGS. 2 and 4, one or more backface scrapers 50 can be fixed or otherwise connected to the last machined surface 55, and protrude into close proximity with the backface 53. Close proximity is defined as the backface scrapers 50 being a fraction of an inch from the backface 53, but not in direct contact with the backface 53. The backface scraper 50 is mounted to the leg 25 closer to the bearing pin axis 61 than the gage surface scraper 32. The backface scraper 50 operates to clean the backface 53 of the rotary cone 12 from debris to similarly prevent erosion of the bit 10. The backface scraper 50 has a flat outer end perpendicular to the axis 61 of bearing pin 60. The backface scraper 50 is closer to the bearing pin axis 61 than the gage scraper 32.

In operation, as drill bit 10 rotates, each cone 12 rotates along its axis 61 and the cutting elements 43 on the outer cutting surface 41 of cone 12 perform earth boring operations. During the process of earth boring, foreign material or debris such as mud may form on the gage surface 30 of the rotary cone 12. The gage surface scraper 32 cleans or scrapes away the packed debris from the gage surface 30 as the cone 12 is rotating about its axis 61.

The invention has significant advantages. The gage scraper 32 reduces accumulation of mud and cuttings on the gage surface. A cleaner gage surface reduces mud packing in the seal recess, prolonging the life of the seal. The cleaner gage surface 32 may also increase the rate of penetration, thus improving overall performance of the drill bit 10.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

That which is claimed is:

1. In an improved earth boring drill bit having a body with at least one leg depending therefrom, a bearing pin secured to the leg, a cone rotatably mounted to the bearing pin, the cone having a gage surface, the improvement comprising;

a scraper mounted on the leg and protruding into close proximity with the gage surface to clean debris from the gage surface;

wherein the scraper comprises an insert having a base portion press-fitted into a hole in the inside surface of the leg; and wherein the insert is made from a carbide material.

2. The apparatus of claim 1, wherein the scraper has a surface that is substantially parallel to a portion of the gage surface when viewed in cross-section.

3. The apparatus of claim 1, wherein a distance from an axis of the bearing pin to the scraper is greater than a distance from the axis of the bearing pin to an inner edge of the gage surface.

4. The apparatus of claim 1, wherein the scraper is chisel shaped, having a pair of flanks converging to a crest.

5. The apparatus of claim 4, wherein the crest is substantially tangent to a circle surrounding the bearing pin axis.

6. An apparatus for boring earth, comprising:

a body having at least one leg with a bearing pin depending therefrom;

a cone mounted to the bearing pin for rotating about an axis of the bearing pin, the cone having an outer cutting surface and a conical gage surface joining the outer cutting surface, and a backface joining the gage surface, the backface being in a plane perpendicular to the axis of the bearing pin;

a plurality of cutting elements protruding from the outer cutting surface;

a gage scraper press-fitted into a hole in an inside surface of the leg and protruding from the leg toward the gage surface to clean debris from the gage surface, the gage scraper being radially farther from the axis of the bearing pin than a radial distance from the axis of the bearing pin to a junction of the backface with the gage surface; and wherein the scraper has a planar surface that is generally parallel with a portion of the gage surface.

7. An apparatus for boring earth, comprising:

a body having at least one leg with a bearing pin depending therefrom;

a cone mounted to the bearing pin for rotating about an axis of the bearing pin, the cone having an outer cutting surface and a conical gage surface joining the outer cutting surface, and a backface joining the gage surface, the backface being in a plane perpendicular to the axis of the bearing pin;

a plurality of cutting elements protruding from the outer cutting surface;

a gage scraper press-fitted into a hole in an inside surface of the leg and protruding from the leg toward the gage surface to clean debris from the gage surface, the gage scraper being radially farther from the axis of the bearing pin than a radial distance from the axis of the bearing pin to a junction of the backface with the gage surface; and wherein the scraper has two flanks and a crest.

8. The apparatus of claim 7, wherein the scraper has a tip that protrudes past the backface, relative to the axis of the bearing pin.

9. The apparatus of claim 7, wherein the scraper has an axis that is substantially parallel to an axis of the bearing pin.

10. The apparatus of claim 7, further comprising a backface scraper mounted to the leg closer to the bearing pin axis than the gage scraper in order to clean the backface.

11. The apparatus of claim 7, wherein the scraper is chisel shaped.

12. The apparatus of claim 7, wherein the crest is generally perpendicular to a radial line of the bearing pin.

13. An apparatus for boring earth, comprising:

a body having at least one leg, the leg having a bearing pin with a bearing pin axis;

a cone having a cavity that rotatably fits on the bearing pin;

an annular flat backface on the cone surrounding the cavity and perpendicular to an axis of the cone, the backface being parallel to a last machined surface formed on an inside surface of the leg;

a conical gage surface extending from the backface to an outer cutting surface of the cone;

a backface scraper mounted to the last machined surface and protruding into close proximity with the backface; and a gage scraper protruding from an inside surface of the leg past the backface and overlying a portion of the gage surface to clean debris from the gage surface, the gage scraper being radially farther from the bearing pin axis than a junction of the backface and gage surface to the bearing pin axis, the scraper being chisel shaped.

14. The apparatus of claim 13, wherein the gage scraper has two flanks converging to a crest, and wherein one of the flanks is substantially parallel to a portion of the gage surface.

15. The apparatus of claim 13, wherein the gage scraper has two flanks converging to a crest, the crest being perpendicular to a radial line of the bearing pin axis.

16. The apparatus of claim 13, wherein the gage scraper is located radially past the last machined surface.

17. The apparatus of claim 13, wherein the gage scraper has an axis that is parallel to the bearing pin axis.

* * * * *